US006607013B1

(12) United States Patent
Leoni

(10) Patent No.: US 6,607,013 B1
(45) Date of Patent: Aug. 19, 2003

(54) AUTOMATIC BAR

(76) Inventor: Mauro Leoni, Via Carovelli 17/E, I-22074 Lurate Caccivio Como (IT)

( * ) Notice: Subject to any disclaimer, the term of this patent is extended or adjusted under 35 U.S.C. 154(b) by 0 days.

(21) Appl. No.: 09/890,510

(22) PCT Filed: Feb. 22, 2000

(86) PCT No.: PCT/EP00/01466

§ 371 (c)(1),
(2), (4) Date: Jul. 31, 2001

(87) PCT Pub. No.: WO00/58200

PCT Pub. Date: Oct. 5, 2000

(30) Foreign Application Priority Data

Mar. 26, 1999 (IT) ..... MI99A0629

(51) Int. Cl.[7] ..... B67D 1/00

(52) U.S. Cl. ..... 141/104; 141/145; 222/129.1; 222/129.4; 222/144; 222/144.5; 222/168

(58) Field of Search ..... 141/100, 103, 141/104, 144, 145; 222/129.1, 129.3, 129.4, 144, 144.5, 168, 168.5

(56) References Cited

U.S. PATENT DOCUMENTS 3,675,820 A * 7/1972 Newberry et al. ..... 222/129.4
3,827,467 A * 8/1974 Henley et al. ..... 141/104
4,258,759 A * 3/1981 Achen ..... 141/100
4,928,853 A 5/1990 Isham et al.
4,951,719 A 8/1990 Wiley et al.
5,111,855 A * 5/1992 Boeck et al. ..... 141/103

FOREIGN PATENT DOCUMENTS

| | | |
|---|---|---|
| BE | 1 005 369 | 7/1993 |
| FR | 2 624 844 | 12/1987 |
| GB | 2 303 354 | 7/1995 |
| WO | WO 85/04157 | 3/1985 |

* cited by examiner

*Primary Examiner*—J. Casimer Jacyna
(74) *Attorney, Agent, or Firm*—Hedman & Costigan, P.C.

(57) ABSTRACT

An automatic device for preparing mixed and non-mixed beverages having a load-bearing structure (22), a conveyor (21) designed to convey containers (26) into a set position under a motor-driven rotary head (12,32) having a plurality of receptacles (13,33) for ingredients to be poured into the containers (26) on the conveyor where each receptacle (13, 33) has an automatic-dosing actuation valve (24, 34) and the said device (10) includes an automatic system (20) for managing positioning of the dispensers over the containers.

12 Claims, 2 Drawing Sheets

AUTOMATIC BAR

BACKGROUND OF THE INVENTION

The present invention refers to a device for automatic preparation of mixed and non-mixed beverages, such as alcoholic-and non-alcoholic cocktails.

It is known that in public establishments, such as discotheques, pubs, music bar-rooms, etc., the customers are served alcoholic or non-alcoholic cocktails or other similar beverages, either mixed and non-mixed, hereinafter referred to, for reasons of simplicity, as "mixed beverages".

This service is generally performed by a specialized waiter or bartender, who carries out manually the traditional operations for the preparation of the beverage that has been ordered, such as: choice of the most suitable glass for the type of cocktail to be prepared, possible addition of ice, handling of the bottles containing the basic ingredients for the cocktail, manual dosing using possible dosers, possible manual mixing or shaking of the cocktail, and possible final garnishing of the cocktail which is to be served to the customer.

Such operations as the ones described above of course require a fair amount of manual skill, accurate dosing, as well as a certain amount of time to be carried out. As a result, there may occur delays in serving the customers, with consequent possible loss of patience and dissatisfaction of the latter, above all in the case where the premises are very crowded, and there may be some waste in dosing the ingredients.

An attempt to solve this problem has been made by proposing a machine equipped with a plurality of tanks containing the ingredients to be mixed and a plurality of pipes for conveying, under pressure, these ingredients into a glass. Associated to each one of said pipes is a dosing valve, and both the elements for conveying the individual ingredients and the dosing valves are controlled by an appropriate program that operates the machine in such a way as to produce a mixed beverage corresponding to the choice made by the customer.

Although a system of this kind automates preparation of cocktails, it is particularly unsatisfactory for at least the reasons explained in what follows.

In the first place, the structure consisting of the numerous pipes for feeding the ingredients is particularly complex and costly, both as regards installing it on the machine and as regards keeping it clean and operating efficiently.

In the second place, the said machine basically reproduces the operating and aesthetic characteristics of traditional coffee-vending machines that are generally present in offices, this being an aspect that limits the possibility of them being used in smart or trendy establishments.

The purpose of the present invention is therefore to create a device for the preparation of mixed and non-mixed beverages that does not require any intervention on the part of the operator beyond the choice of the desired type of cocktail.

A further purpose of the invention is to create a device that presents a structure such as to represent an attractive element for the clientele.

These and other purposes are achieved by a device for automatic preparation of mixed and non-mixed beverages, according to claim 1, to which the reader is referred for reasons of brevity.

Advantageously, the device according to the invention enables automatic preparation of mixed and non-mixed beverages in public establishments, such as discotheques, pubs, music bar-rooms, etc. This is obtained, upon customer request, without any human intervention and in a fast and effective way. Possibly, if so desired and for certain preparations of cocktails, a bartender may manually shake a container of a shaker type containing the beverage previously mixed by the device of the invention, before serving it to the customer.

Consequently, long waiting times at the bar are avoided in the case where the premises are crowded, and in any case there is an orderly sequence of access to the device and of operations required for the preparation and serving of the cocktail.

Owing to its versatility, the device according to the invention also enables serving of non-mixed beverages, such as non-alcoholic beverages or beer.

In addition, the device according to the invention, owing to its peculiar rotary-head structure, which is designed also to serve as an element of attraction and appeal, lends itself in an ideal way to being used in the widest variety of public establishments, in particular, but not exclusively, in establishments frequented by young people or in trendy establishments.

Further purposes and advantages of the present invention will emerge clearly from the ensuing description and from the annexed drawings, which are provided purely to give explanatory and non-limiting example, and in which:

DETAILED DESCRIPTION OF THE INVENTION

Figure 1:
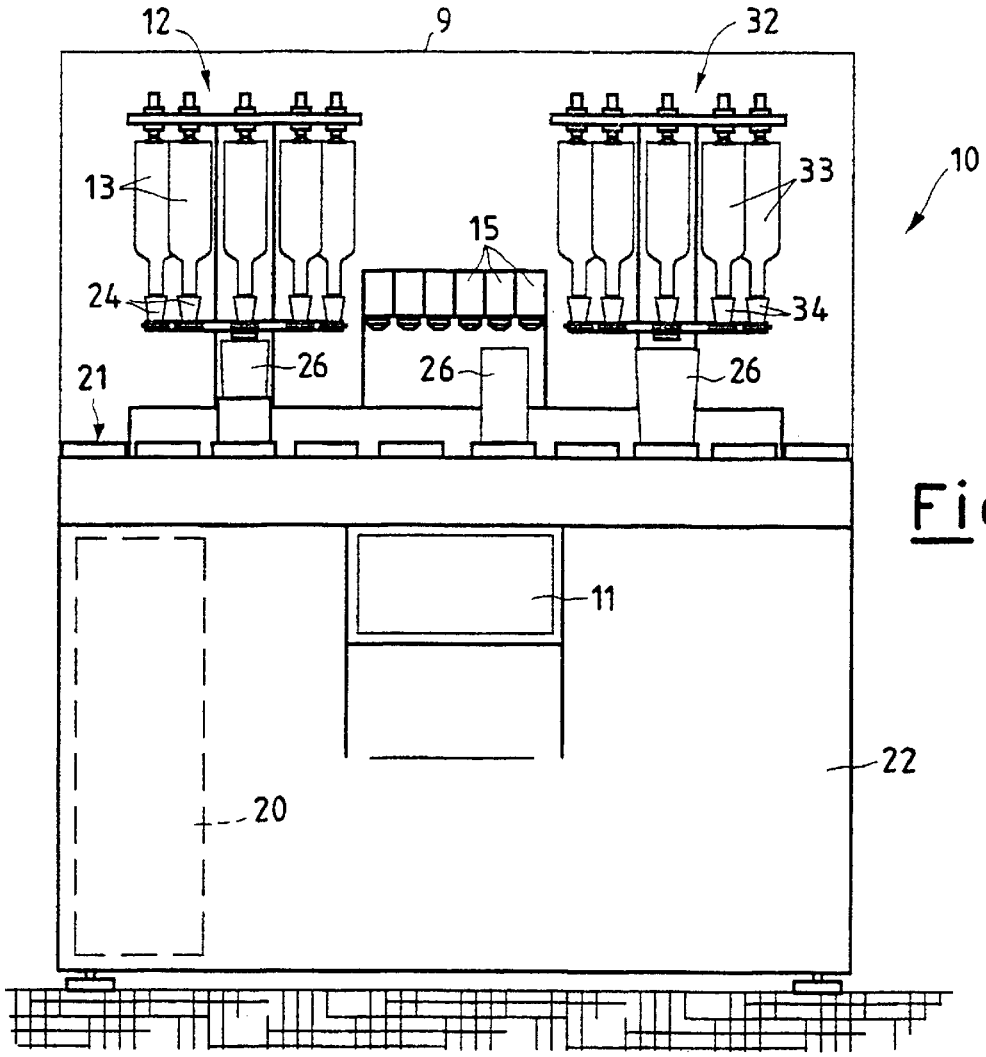
FIG. 1 represents a front elevation of the device for automatic preparation of mixed and non-mixed beverages according to the present invention.
Figure 2:
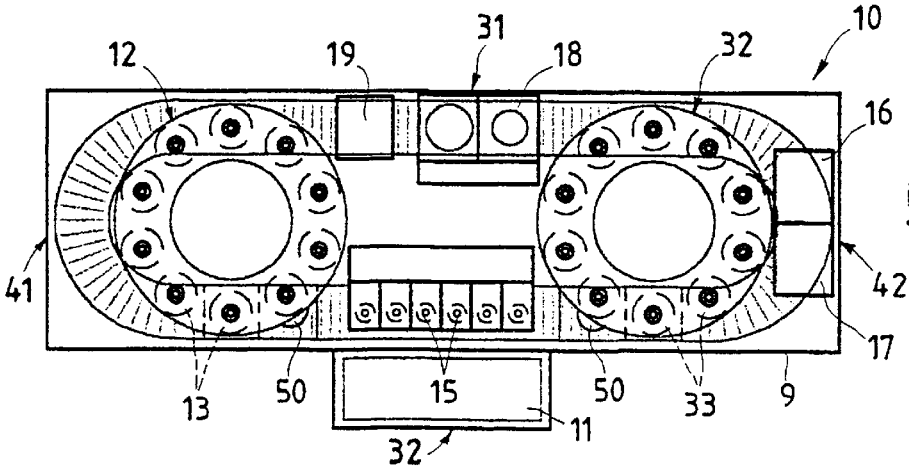
FIG. 2 represents a top view of the device for automatic preparation of mixed and non-mixed beverages shown in FIG. 1.

With particular reference to the above-mentioned figures, the device for automatic preparation of mixed and non-mixed beverages according to the invention is designated as a whole by the reference number 10.

The device 10 comprises an automatic conveyor belt 21 which moves along a continuous path on a bench 22. The conveyor belt 21 consists of a plurality of sectors 50 which define spaces for accommodating and supporting containers 26 for the mixed beverages. The said sectors 50 are preferably arranged at a fixed distance apart.

The containers 26 may be, for example, according to the cocktails ordered, glasses or shaker-type containers.

The device 10 is also provided with a pair of motor-driven rotary heads 12, 32, each of which, according to a first preferred embodiment of the present invention, supports a plurality of upturned bottles 13, 33, which have the function of receptacles for the ingredients necessary for preparing the cocktails.

In addition, each of the upturned bottles 13, 33 is equipped with an automatically operating dosing valve 24, 34. The valves 24, 34 are provided with the possibility of automatic operation of dosing by means of a magnetic actuator.

The upturned bottles 13, 33 may contain spirits or syrups, or other beverages suitable for preparing cocktails. They may also comprise refrigerated bottles, for instance bottles containing milk, cream, sparkling drinks like spumante, or other beverages. The bench 22 serves as a support for the structure of the device 10 described and is also used as an element for containing refrigerating machines, which are in themselves known, as well as for containing the control system 20.

The bench 22 may be provided with a transparent protective shield 9, for example made of Plexiglas.

The device 10 for automatic preparation of mixed and non-mixed beverages is further completed by a set of electrically operated dosing valves 15 with pre-mix or post-mix functions, for effervescent drinks or beer. The entire device may moreover be operated at a distance according to appropriate control programs.

According to an alternative embodiment of the present invention, each of the receptacles 13, 33 consists of an upturned imitation bottle which has, in a position corresponding to its bottom, an attachment to a pipe (not shown in the figures), which has the purpose of conveying the liquid to be poured into the container 26, drawing the said liquid from a corresponding tank containing a spirit or a syrup, or some other ingredient for cocktails.

Further characteristics of the present device 10, which may possibly be envisaged in preferential embodiments of the present invention, involve integration of the device 10 with an automatic ice dispenser 16.

In a similar way, it is possible to envisage an automatic dispenser 17 of garnishing, an automatic feeder of plastic glasses 18, and an automatic mixer or shaker 19. Associated to the device 10 is an automatic control system, indicated schematically by the reference number 20, for managing the feed positions of the containers 26, for example cocktails glasses, and which controls also the choice of ingredients and their reciprocal doses in a timed or weighted manner.

The device 10 is also provided with a display system of its own, equipped with an interface for an operator or for a customer, which comprises a display 11 (for instance, a monitor or an LCD display), preferably of the touch-screen type, for entering the data corresponding to the orders.

Such an interface is preferably set in a position corresponding to the place where the glasses 26 come out and envisages enabling by the customer using a badge or a banknote.

Operation of the device 10 for automatic preparation of mixed and non-mixed beverages according to the invention is as described below.

The customer who wishes to drink a cocktail or some other beverage can select the beverage of his choice on the display 11 after he has obtained enabling of the machine by means of a badge or a banknote.

Figure 3:
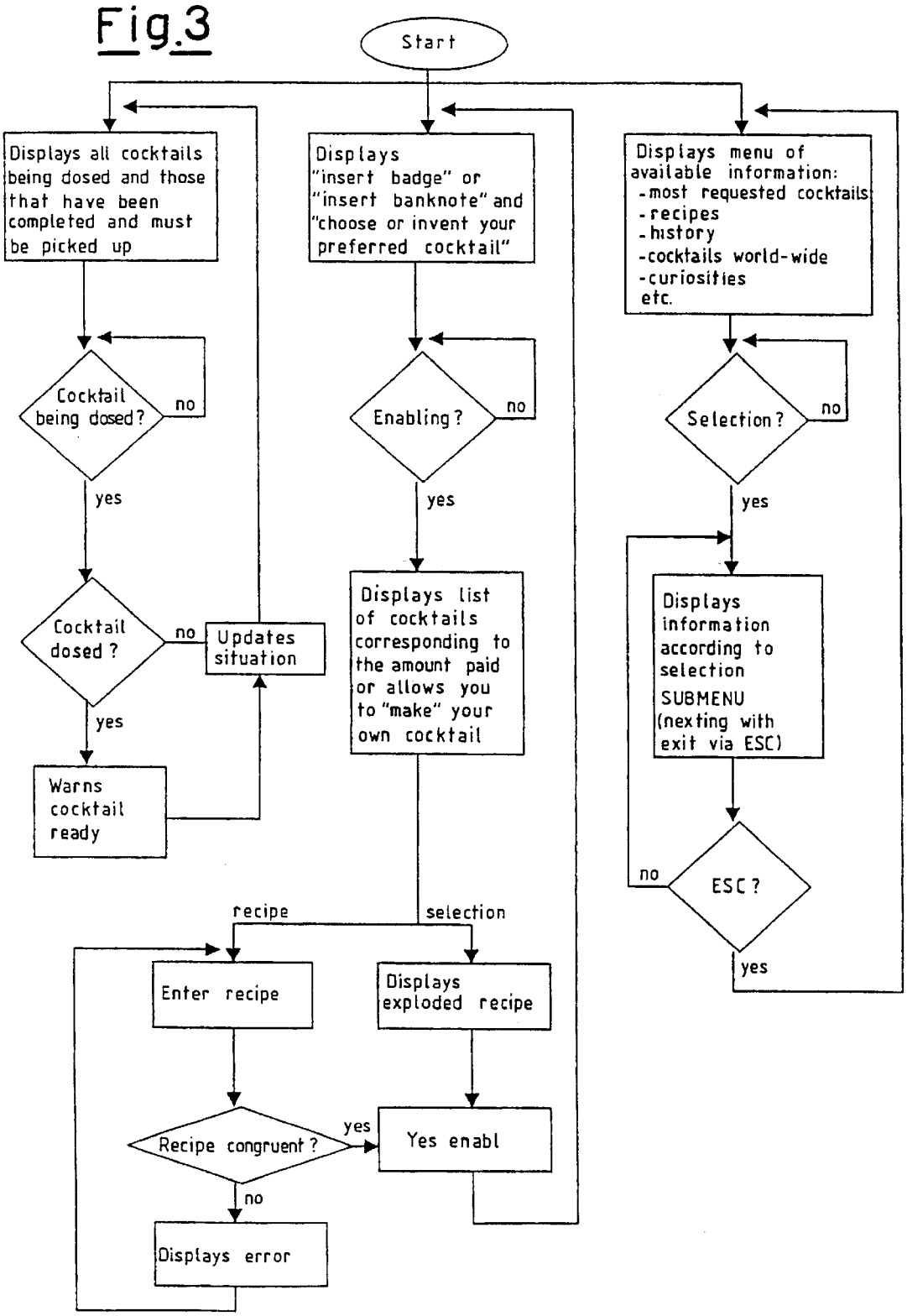
FIG. 3 is a flow chart illustrating the operating logic of the system for controlling the device according to the invention.

This step is indicated in detail in the flow chart of FIG. 3, where it is highlighted that the customer may select one of the cocktails contained in the menu, or else may himself enter a recipe of his own, and the control system is able to carry out the steps necessary for preparing the cocktail that has been entered after it has first carried out a check on the congruence of the ingredients.

The display 11 is able also to display and update in real time the list of the cocktails being prepared and to present, upon request, a set of information about the world of cocktails, such as the most requested cocktails, recipes, the history of cocktails, and curiosities concerning individual cocktails, etc.

On the internal front side 31 the glass 26 is loaded manually (which may also be a glass container chosen preferably from among three different types: medium tumbler, large tumbler, or a shaker/mixing glass).

Alternatively, a plastic glass may be automatically loaded by means of the feeder 18.

The choice of the cocktail made by the customer activates the control system 20 of the device 10, which by means of appropriate motor-driven units, sets the head 12 in rotation so as to bring the bottle 13 containing one of the ingredients of the cocktail selected into a position corresponding to the vertical axis of the glass 26 and in such a way as to operate the automatic valve 24 for the time necessary for delivering the suitable amount of ingredient into the glass 26.

The conveyor belt 21 conveys the glass 26 towards the head 32, and similar dosing operations are performed, once again according to the instructions coming from the control system 20, by the head 32, which, rotating through an appropriate angle, brings the bottle 33 containing a second ingredient for the cocktail selected into a position corresponding to the vertical axis of the glass 26 and operates the automatic valve 34 for the time necessary to deliver the appropriate amount of the said second ingredient into the glass 26.

On the left-hand side of the device 10, ice and/or garnishing may possibly be dispensed by means of operation of the corresponding devices, i.e., the automatic ice dispenser 16 and the automatic garnishing dispenser 17.

On the outer front side 32 of the device 10, the dispensing in the various suitable points is provided by operation of the appropriate valve 15, in the case that the customer has chosen, as an alternative to a cocktail, beer or a non-alcoholic drink.

On the right-hand side 41 of the device 10, the customer takes the cocktail from an automatic hatch in all cases where the cocktail does not require further treatment.

Alternatively, on the internal front 31, a bartender takes out the container 26 when the beverage requires further treatment, such as mixing, shaking, filtering of ice, and garnishing, and pours it into a special container, for example a goblet, and puts it on the conveyor belt 21.

In this latter case, the customer takes the cocktail ready for drinking and possibly garnished from an automatic hatch set on the left-hand side 42.

From the foregoing description there emerge clearly the characteristics and advantages of the device for automatic preparation of mixed beverages which forms the subject of the present invention.

In particular, the advantages are represented, in the first place, by the fact that the device 10 enables automation of the numerous manual activities generally necessary for preparing cocktails.

This result is achieved without excluding the possibility of the customer ordering non-mixed beverages, such as non-alcoholic drinks or beer.

The device moreover makes it possible for the customer to be served a cocktail of his own choice, possibly according to a recipe entered by the customer himself, and for the customer to garnish the cocktail as he wishes.

Finally, the device 10 offers an evidently innovative structure designed to attract the attention of the clientele in a very wide variety of public establishments.

Finally, it is clear that numerous variations may be made to the device for automatic preparation of mixed and non-mixed beverages, which forms the subject of the present invention, without thereby departing from the principles of novelty inherent in the inventive idea, and likewise it is clear that, in the practical implementation of the invention, the materials,. shapes and sizes of the items illustrated may be any whatsoever according to the requirements, and the said items may be replaced with others that are technically equivalent.

What is claimed is:

1. A device for automatic preparation of mixed and non-mixed beverages, characterized in that it comprises, on a load-bearing structure (22), a conveyor (21) designed to convey one or more containers (26) for the above-mentioned mixed and non-mixed beverages, and at least one motor-driven rotary head (12, 32) which carries a plurality of receptacles (13, 33) for the ingredients to be poured into the said containers (26), each one of the said receptacles (13, 33) being equipped with an automatic-dosing actuation valve (24, 34), and to the said device (10) there being associated an automatic system (20) for managing mutual positioning between the said containers (26) and the said automatic-dosing actuation valves (24, 34).

2. Device according to claim 1, characterized in that the said automatic system (20) controls the choice of the ingredients and their mutual dosing.

3. Device according to claim 1, characterized in that each of the said receptacles (13, 33) consists of an upturned bottle containing a spirit or a syrup, or another ingredient for cocktails.

4. Device for automatic preparation of mixed and non-mixed beverages, characterized in that it comprises, on a load-bearing structure (22), a conveyor (21) designed to convey one or more containers (26) for the above-mentioned mixed and non-mixed beverages, and at least one motor-driven rotary head (12,32) which carries a plurality of receptacles (13,33) for the ingredients to be poured into the said containers (26), each one of the said receptacles (13, 33) being equipped with an automatic-dosing actuation valve (24, 34), and to the said device (10) there being associated an automatic system (20) for managing mutual positioning between said automatic-dosing actuation valves (24, 34) wherein each one of the said receptacles (13, 33) is connected, by means of a pipe, to a corresponding tank containing a spirit or a syrup, or another ingredient for cocktails.

5. Device according to claim 4, characterized in that it comprises two motor-driven rotary heads (12, 32) for supporting the said receptacles (13, 33).

6. Device according to claim 5, characterized in that it further comprises a fixed set of electrically operated dosing valves (15) which can be operated automatically for dispensing other beverages contained in additional tanks.

7. Device according to claim 6, characterized in that the said conveyor (21) is a belt and is provided with a plurality of sectors (50) which define spaces for accommodating and supporting the said containers (26).

8. Device according to claim 7, characterized in that it is provided with a display system equipped with a user interface that comprises a display (11) and means for entering the data for the orders.

9. Device according to claim 8, characterized in that it comprises an automatic ice dispenser (16).

10. Device according to claim 8, characterized in that it comprises an automatic garnishing dispenser (17).

11. Device according to claim 8, characterized in that it comprises an automatic feeder (18) of plastic glasses.

12. Device according to claim 8, characterized in that it comprises an automatic mixer (19) for the said mixed and non-mixed beverages.

* * * * *